US007140700B2

(12) United States Patent
Dubé et al.

(10) Patent No.: US 7,140,700 B2
(45) Date of Patent: Nov. 28, 2006

(54) INTERLOCKING SYSTEM FOR PREVENTING SIMULTANEOUS OPENING OF DRAWERS OF A CABINET

(75) Inventors: Claude Dubé, La Pocatière (CA); Richard St-Pierre, St-Jean-Chrysostome (CA); Yves Lord, Saint-Jean-Port-Joli (CA)

(73) Assignee: Rousseau Metal Inc., Quebec (CA)

( * ) Notice: Subject to any disclaimer, the term of this patent is extended or adjusted under 35 U.S.C. 154(b) by 354 days.

(21) Appl. No.: 10/727,509

(22) Filed: Dec. 5, 2003

(65) Prior Publication Data

US 2004/0130246 A1 Jul. 8, 2004

(51) Int. Cl.
*E05C 7/06* (2006.01)

(52) U.S. Cl. ..... 312/221; 312/217

(58) Field of Classification Search ..... 312/215, 312/216, 217, 218, 219, 220, 221, 107.5
See application file for complete search history.

(56) References Cited

U.S. PATENT DOCUMENTS

| | | | | | |
|---|---|---|---|---|---|
| 1,613,731 | A | * | 1/1927 | Stockov | 312/221 |
| 3,259,444 | A | * | 7/1966 | Friend | 312/221 |
| 3,404,929 | A | | 10/1968 | Wright et al. | 312/216 |
| 3,622,216 | A | * | 11/1971 | Haunost | 312/219 |
| 3,874,755 | A | * | 4/1975 | Hegg et al. | 312/221 |
| 4,272,138 | A | * | 6/1981 | Stark | 312/221 |
| 4,396,239 | A | | 8/1983 | Wissman | 312/216 |
| 4,425,013 | A | | 1/1984 | Killen | 312/216 |
| 4,770,476 | A | * | 9/1988 | Lakso | 312/220 |
| 4,838,624 | A | | 6/1989 | Walla | 312/221 |
| 4,854,653 | A | * | 8/1989 | Lakso | 312/222 |
| 4,966,423 | A | * | 10/1990 | Higuera et al. | 312/221 |
| 5,040,858 | A | * | 8/1991 | Kruse et al. | 312/221 |
| 5,333,949 | A | * | 8/1994 | McGregor | 312/221 |
| 5,599,077 | A | * | 2/1997 | Law et al. | 312/221 |
| 5,782,545 | A | * | 7/1998 | Kahara et al. | 312/217 |
| 5,862,689 | A | * | 1/1999 | Wen | 70/85 |
| 6,238,024 | B1 | | 5/2001 | Sawatzky | 312/221 |
| 6,896,342 | B1 | * | 5/2005 | Cheng | 312/221 |
| 2004/0051425 | A1 | * | 3/2004 | Chen | 312/217 |

* cited by examiner

*Primary Examiner*—Peter M. Cuomo
*Assistant Examiner*—Noah Chandler Hawk
(74) *Attorney, Agent, or Firm*—Baker & Hostetler LLP

(57) ABSTRACT

An interlocking system for preventing simultaneous opening of drawers of a cabinet, including activation members affixable to back sides of the drawers and coupled to carriage members slideably mounted in guide supports affixable in the cabinet behind the drawers in respective registration with the activation members. An elongated track member affixable in the cabinet on a side of the guide supports slideably guides a stack of mobile blocks between which bolt elements projecting from the carriage members are driveable only one at a time due to a limited space provided for displacement of the blocks and for insertion of one of the bolt elements. The carriage members slide using the pulling and pushing motions of the activation members when the drawers are opened and closed. Due to the limited space, only one bolt element is insertable between the mobile blocks and only one drawer is openable at a same time.

17 Claims, 10 Drawing Sheets

INTERLOCKING SYSTEM FOR PREVENTING SIMULTANEOUS OPENING OF DRAWERS OF A CABINET

FIELD OF THE INVENTION

The present invention relates to safety mechanisms for cabinets, and more particularly to an interlocking system for preventing simultaneous opening of drawers of a cabinet.

BACKGROUND

When using a cabinet having several drawers, there is always a risk of tipping the cabinet if more than one loaded drawer is opened at the same time. It then becomes desirable to provide the cabinet with a mechanism preventing the simultaneous opening of several drawers. There are currently many different mechanisms on the market proposed for accomplishing this function.

Examples of such mechanisms can be found in U.S. patent Nos. U.S. Pat. No. 3,404,929 (Wright et al.), U.S. Pat. No. 4,396,239 (Wissman), U.S. Pat. No. 4,425,013 (Killen), U.S. Pat. No. 4,838,624 (Walla) and U.S. Pat. No. 6,238,024 (Sawatzky), showing various models of interlocking or anti-tip systems for cabinets.

One of the existing problems in many of the proposed mechanisms is that, even though it is not possible to open a second drawer when one drawer is already opened, it is still possible to open multiple drawers if they are all opened at the same time. Also, many mechanisms are large and take a lot of space at the cost of the space for the drawers and thus the space available for storage of articles (i.e. reduced ratio of drawer size with respect to cabinet size).

Many mechanisms are difficult to install and also to reconfigure when such a possibility exists for changing the drawer positions. Tools are usually required for achieving such operations.

Another problem occurs during preparation of the cabinet. Indeed, when time comes to place all the drawers in the cabinet, it is necessary to perform a manual reset of the mechanism after having inserted each drawer to enable insertion of a second one, and then a third one, etc. This extends the assembly times and represents a certain difficulty when inserting the last drawers when they are deep and little high. Indeed, it becomes then complex to reactivate the mechanism because of the constricted space left by the missing drawer. Furthermore, when this operation is achieved on the spot following a reconfiguration and by a user not knowing much how the mechanism operates, the user who does not understand that the mechanism must be reactivated after insertion of each drawer will fail to insert the second drawer. The user is then likely to abruptly force the second drawer to close, thereby breaking the pieces of the mechanism.

A frequent problem in the proposed mechanisms is that they do not tolerate lateral or vertical variations in the positions of the operating pieces, which causes malfunction of the mechanisms.

A further problem with many of the proposed mechanisms is that they are often sensible to vibrations which may cause undesired release of the drawers.

In addition, a separate device must often be provided to lock all the drawers e.g. for safekeeping valuable articles stored in the cabinet.

SUMMARY

An object of the invention is to provide an interlocking system for preventing simultaneous opening of drawers of a cabinet, which is simple in construction yet is reliable and efficient.

Another object of the invention is to provide such an interlocking system, which takes little space and preserves a high ratio of drawer size with respect to cabinet size.

Another object of the invention is to provide such an interlocking system, which is relatively easy and takes little time to install in the cabinet, and which may be reconfigured by a user possibly without requiring tools and without risk of breaking the pieces of the system.

Another object of the invention is to provide such an interlocking system, which tolerates lateral or vertical variations in the positions of the operating pieces.

Another object of the invention is to provide such an interlocking system, which exhibits a certain resistance to vibrations.

Another object of the invention is to provide such an interlocking system, which is ready for adaptation as a drawer locking device.

According to the present invention, there is provided an interlocking system for preventing simultaneous opening of drawers of a cabinet, comprising:

activation members respectively affixable to back sides of the drawers;

guide supports respectively affixable in the cabinet behind the drawers, in respective registration with the activation members;

an elongated track member affixable in the cabinet on a side of the guide supports;

a series of mobile blocks slideably guided by the track member, the track member limiting the blocks to a partial displacement to produce a space between any two of the blocks;

carriage members respectively slideably mounted on the guide supports, the carriage members being movable transversely to the track member, the carriage members respectively having bolt elements projecting towards the track member and drivable one at a time in the space produced by the partial displacement of the blocks by sliding of the carriage members towards the track member; and coupling means respectively extending between the activation members and the carriage members for sliding one of the carriage members towards the track member using pulling motion of a corresponding one of the activation members during opening of a corresponding one of the drawers, provided that the space is vacant for receiving the bolt element of said one of the carriage members, and sliding said one of the carriage members away from the track member using pushing motion of said one of the activation members during closing of said corresponding one of the drawers.

BRIEF DESCRIPTION OF THE DRAWINGS

A detailed description of preferred embodiments will be given herein below with reference to the following drawings, in which like numbers refer to like elements.

DETAILED DESCRIPTION OF THE PREFERRED EMBODIMENTS

Figure 1:
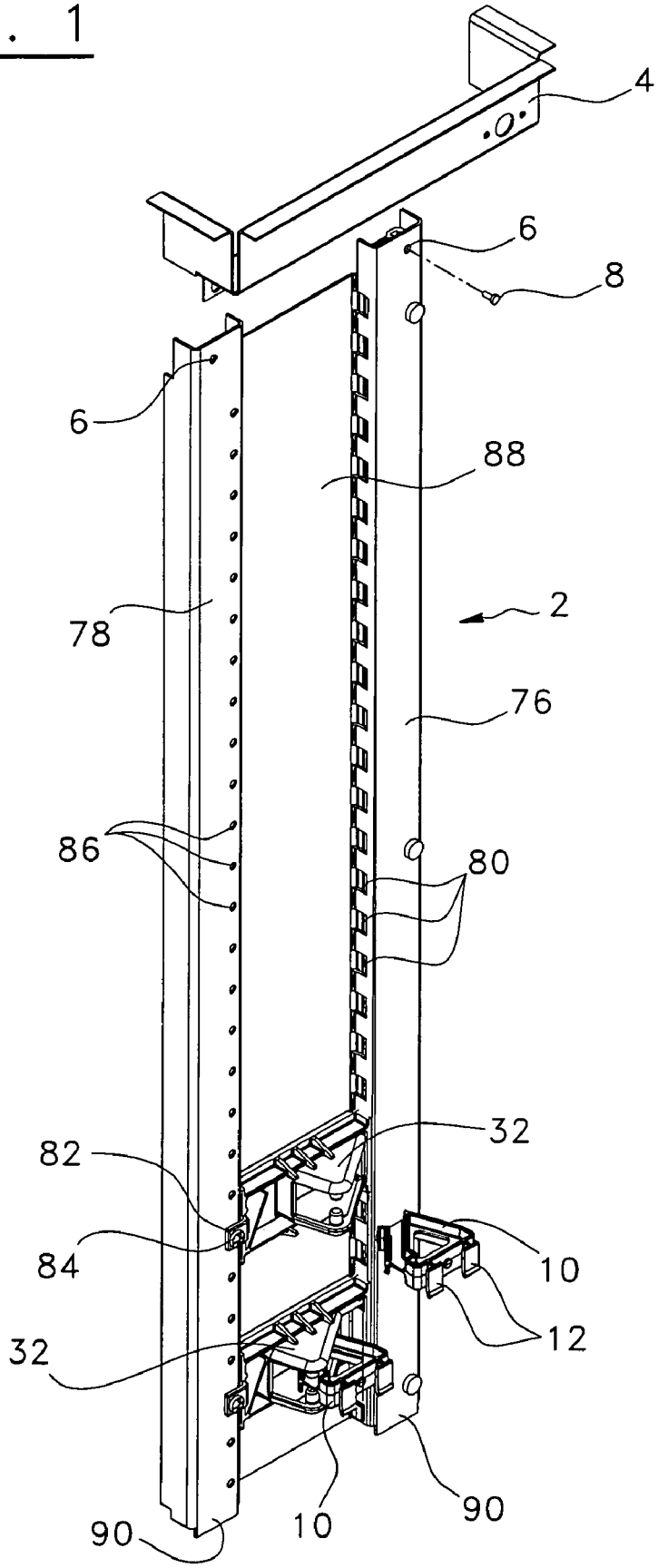
FIG. 1 is a perspective view of an interlocking system according to the present invention.

Referring to FIG. 1, there is shown an interlocking system according to the present invention, for preventing simultaneous opening of drawers of a cabinet (not shown in the Figures).

The interlocking system has activation members 10 respectively affixable to back sides of the drawers. The activation members 10 may have clipping elements 12 adapted to clip in slots made in the back sides of the drawers for this purpose. The activation members 10 can thus be easily and quickly installed without using tools. The activation members 10 can be attached to the drawers in other ways, e.g. with screws or any other appropriate fasteners. They could also be integrated to the back sides of the drawers during their manufacture if desired.

The interlocking system also has guide supports 28 respectively affixable in the cabinet behind the drawers, in respective registration with the activation members 10.

Figure 2:
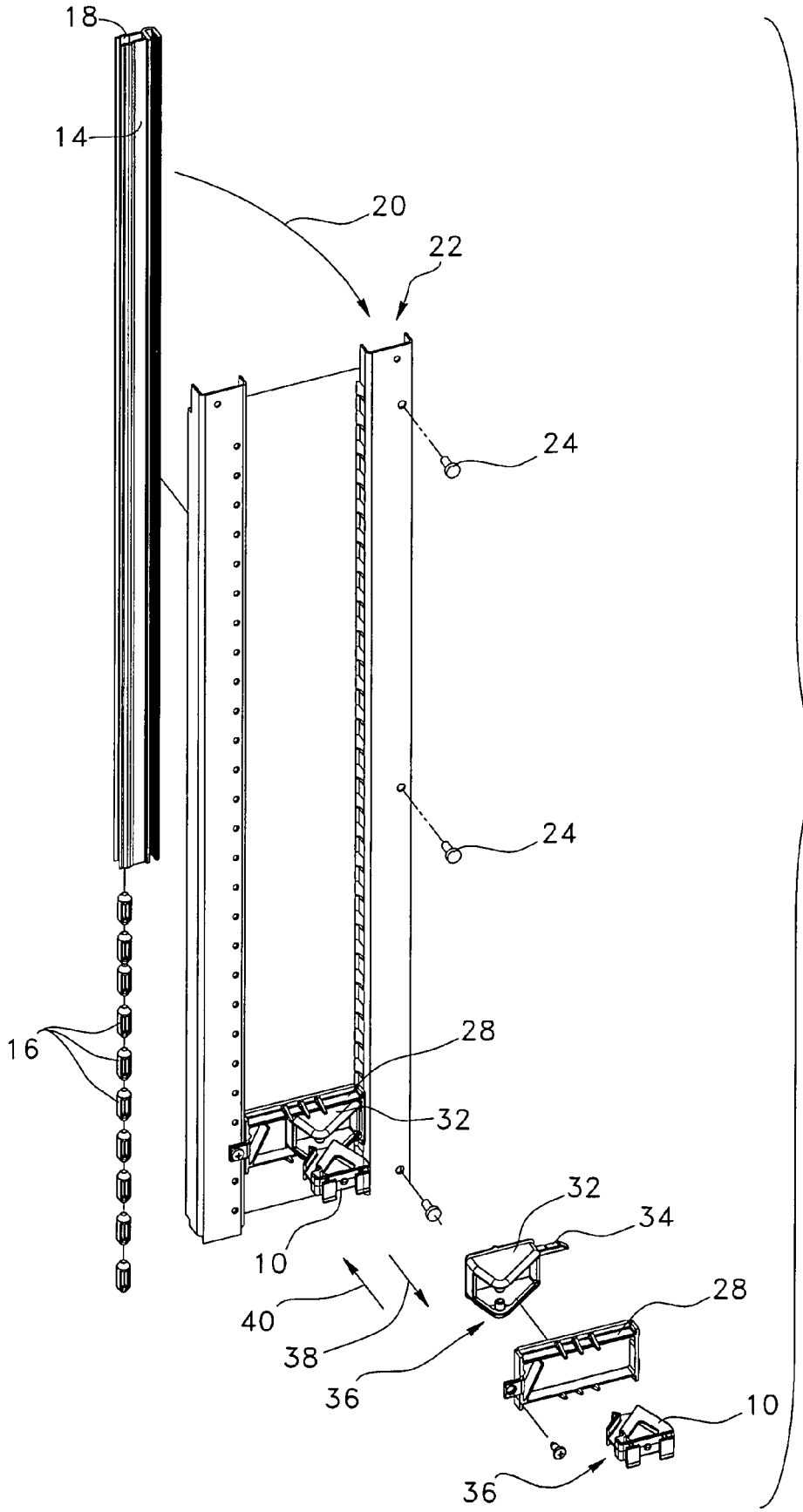
FIG. 2 is an exploded view of an interlocking system according to the present invention.

Referring to FIG. 2, the interlocking system further has an elongated track member 14 affixable in the cabinet on a side of the guide supports 28. A series of mobile blocks 16 are slideably guided by the track member 14. The mobile blocks 16 may be formed of small rods slideably fitting in a longitudinal side channel 18 formed by the track member 14.

The small rods may have a height of e.g. 1 inch (2.54 cm) and be stacked over all the height of the track member 14 or more particularly of the side channel 18 in the illustrated case, with the exception of a space for partial displacement of the blocks 16. The track member can be formed of an aluminum extrusion.

Figure 9:
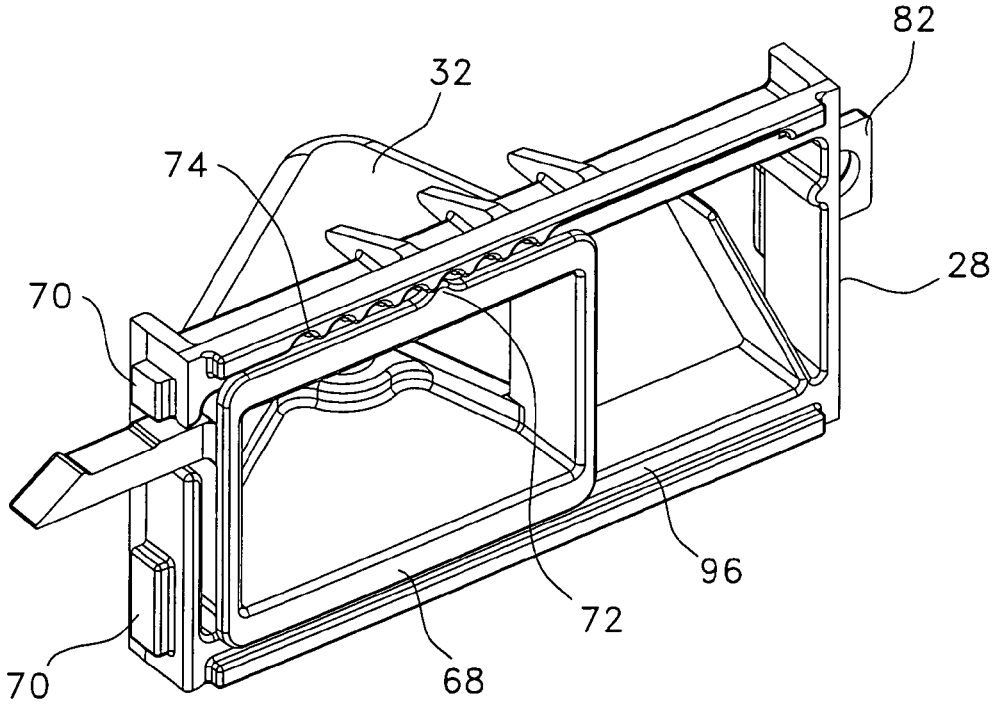
FIG. 9 is a perspective view from behind of a guide support and an associated carriage member according to the present invention.

Referring back to FIG. 1, the interlocking system is provided with a mounting structure 2 which can be in the form of a perforated steel structure used to support the various pieces of the system. The mounting structure 2 is adapted to be strongly secured in the cabinet. The attachment of the mounting structure 2 in the cabinet can be achieved using supporting structures or brackets which can be welded to the top and bottom of the cabinet, such as the upper supporting structure 4 in the illustrated case. The mounting structure has opposite mounting rails 76, 78 affixable in the cabinet behind the drawers and between which the guide supports 28 are mountable, e.g. using hooking projections 70 (as shown in FIG. 9) on one side for hooking attachment through perforations 80 in the mounting rail 76 and projecting brackets 82 screwable to the mounting rail 78 on the opposite side, using self-tapping screws 30 or bolts fitting in holes 86 in the mounting rail 78. Other kinds of attachments can be used to mount the guide supports 28 onto the mounting structure 2, with or without requiring tools if desired. For example, a simple snapping or clipping attachment can be used, preferably in a detachable way so as to be able to adjust the height of the guide supports 28 if desired. The mounting structure 2 may have a back wall 88 extending between the mounting rails 76, 78. The mounting rails 76, 78 may have lower ends provided with downwardly projecting tabs 90 for engagement in slots in the lower supporting structure of the cabinet. The upper ends of the mounting rails 76, 78 can be shaped for engagement in holes in the upper supporting structure 4 of the cabinet. The mounting structure 2 can thus be secured in place by bolting it on the upper support structure 4 using self-tapping screws such as the screw 8 bolted in the holes 6. The installation of the system in the cabinet is thus quick and can easily be achieved by the user if he/she wants to install an interlocking system on a cabinet which had no such system.

The mounting structure 2 can be designed so that the track member 14 can be positioned in a side channel 22 of the mounting structure 2 as depicted by arrow 20, and held in place by bolts 24. The track member 14 is arranged to limit the mobile blocks 16 to a partial displacement to produce a space between any two of the blocks 16. This can be done in multiple ways, e.g. by inserting stopping elements (not shown) in the ends of the track member 14 to leave only a small space along the channel 18. The channel 18 can also have a specific length so that the blocks 16 are originally inserted by pressure. The blocks can be in the form of small balls instead of small rods, or any other desired shape if desired. The track member 14 may also have a different design, e.g. in the form of a guide rail along which the mobile blocks are slideably hanged, in a similar way as in a track for a blind.

Figure 3:
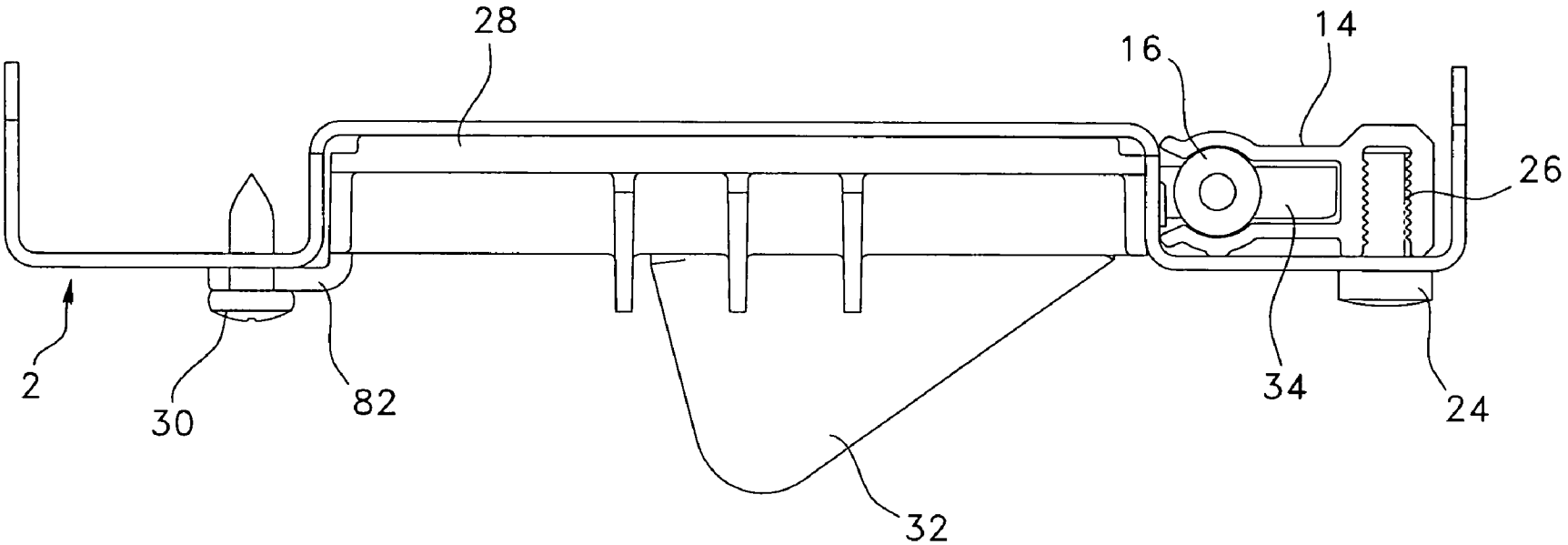
FIG. 3 is a top view of an interlocking system according to the present invention, without the activation blocks.

Referring to FIG. 3, the track member 14 may be provided with a longitudinal slot 26 having inner thread elements for receiving the bolts 24.

Referring back to FIG. 2, carriage members 32 are respectively slideably mounted on the guide supports 28, so as to be movable transversely to the track member 14. The carriage members 32 respectively have bolt elements 34 projecting towards the track member 14 and drivable one at a time in the space in the groove 18 produced by the partial displacement of the blocks 16 by sliding of the carriage members 32 towards the track member 14.

Coupling arrangements 36 respectively extend between the activation members 10 and the carriage members 32 for sliding one of the carriage members 32 towards the track member 14 using pulling motion of a corresponding one of the activation members 10 during opening of a corresponding one of the drawers, as depicted by arrow 38, provided that the space is vacant for receiving the bolt element 34 of the carriage member in question, and for sliding the carriage member 32 away from the track member 14 using pushing motion of the activation member 10 during closing of the drawer, as depicted by arrow 40. The coupling arrangements 36 can be formed of guiding groove and pin arrangements distributed between the activation members 10 and the carriage members 32 as illustrated.

Figure 4A:
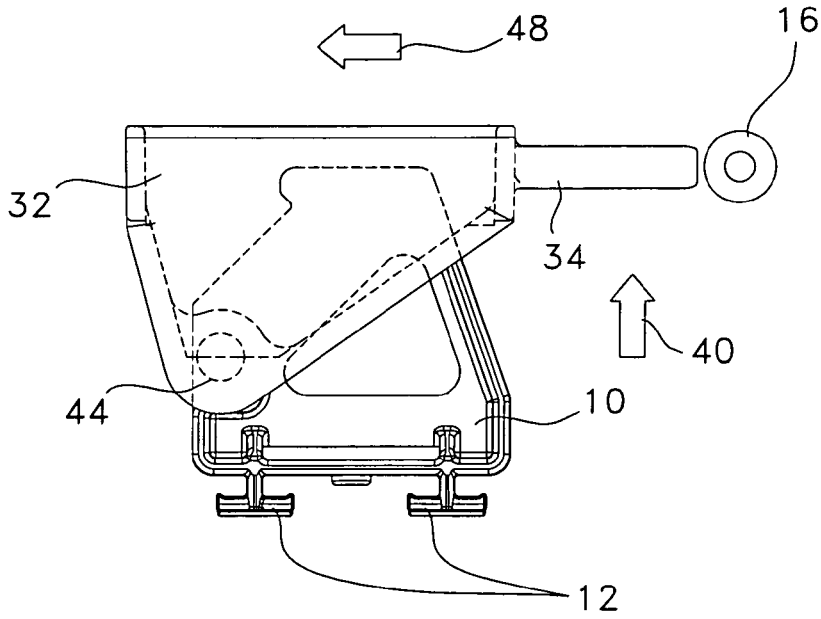
FIG. 4A is a top view of an activation member and an associated carriage member according to the present invention, in drawer closed position.
Figure 4B:
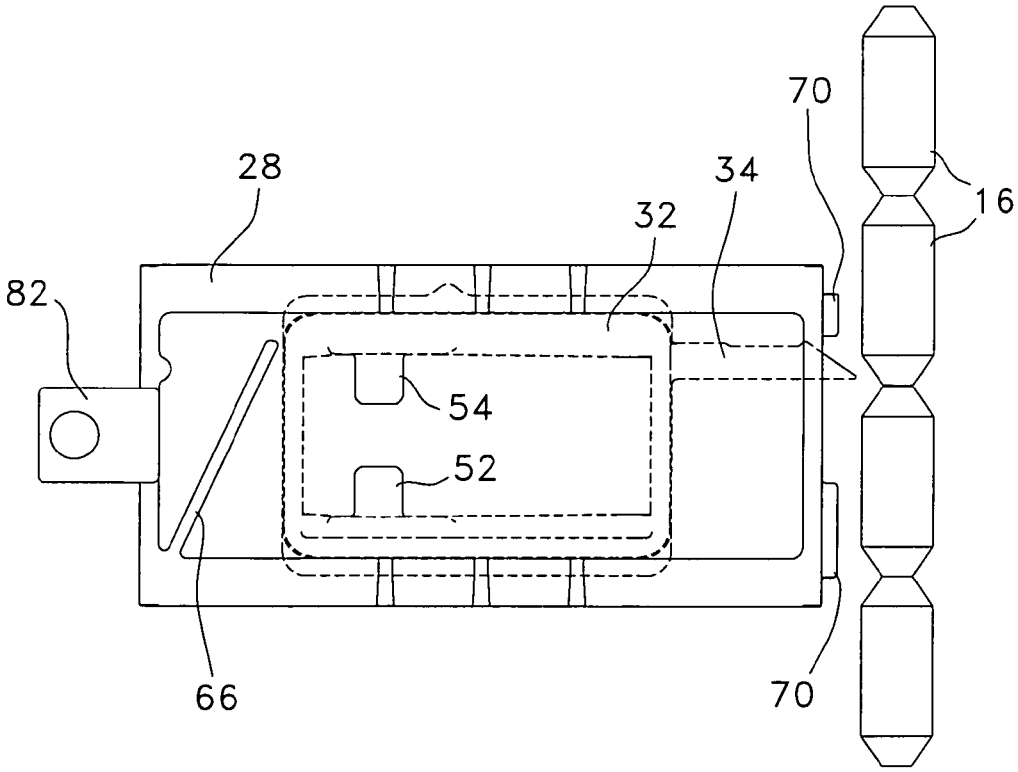
FIG. 4B is a front view of a carriage member on a guide support according to the present invention, in drawer closed position.
Figure 5A:
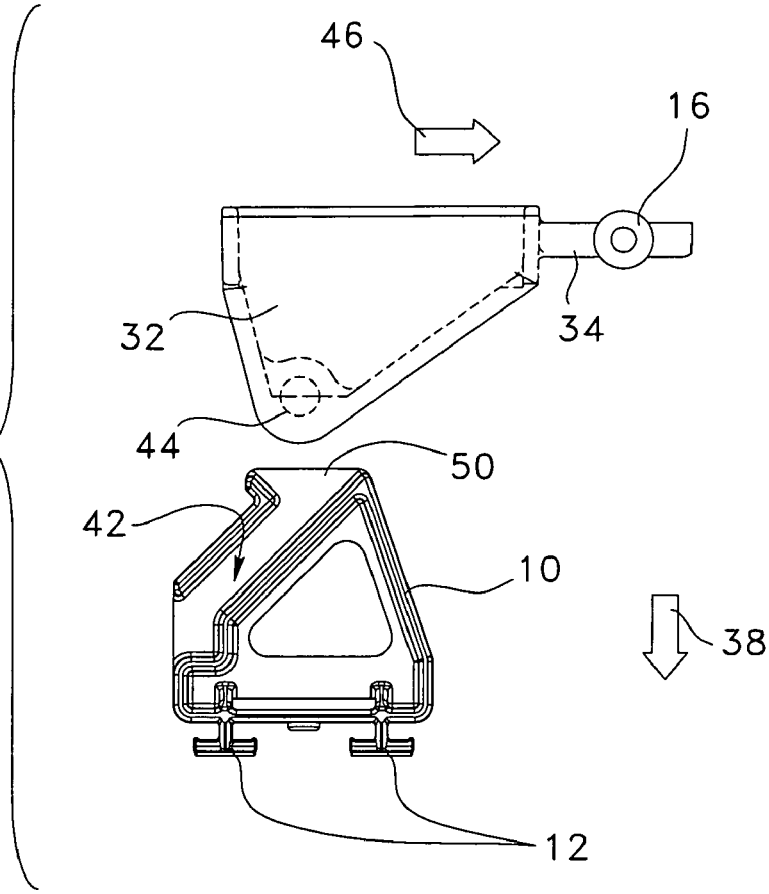
FIG. 5A is a top view of an activation member and an associated carriage member according to the present invention, in drawer opened position.
Figure 5B:
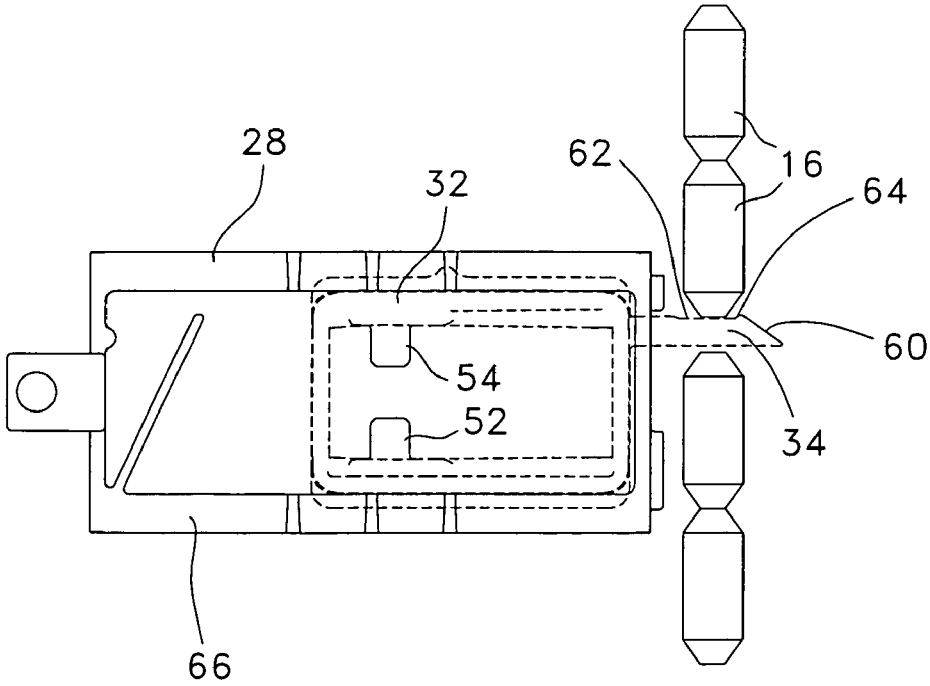
FIG. 5B is a front view of a carriage member on a guide support according to the present invention, in drawer opened position.

Referring to FIGS. 4A–B and 5A–B, there is shown one unit of the interlocking system, without the mounting structure 2 and the track member 14. In FIGS. 4A and 5A, the guide support 28 has also been removed, while in FIGS. 4B and 5B, the activation block 10 has been removed to better illustrate the operation of the mobile pieces of the system. FIGS. 4A–B illustrate the position of the mobile pieces for a closed drawer. FIGS. 5A–B illustrate the position of the mobile pieces for an opened drawer. As shown in FIG. 5A, when a drawer is opened, the activation member 10, which is attached to the back side of the drawer, moves away from the carriage member 32, as depicted by the arrow 38. When engaging in a slanted groove arrangement 42 of the activation block 10, a pin arrangement 44 of the carriage member 32 pushes it on the right as depicted by arrow 46. The bolt element 34 of the carriage member 32 then engages between two small rods 16, causing the pile of small rods 16 above the bolt element 34 to rise as best shown in FIG. 5B. As shown in FIG. 4A, when a drawer is closed, the pin arrangement 44 reengages in the groove arrangement 42, thereby moving the carriage member 32 in the direction of arrow 48, back to its initial standby position as best shown in FIG. 4B. The pin arrangement 44 extending on a front side of the carriage member 32 is engageable in the slanted groove arrangement 42 extending on a rear side of the corresponding activation member 10 and is guided in it upon pulling and pushing motions of the activation member 10.

Figure 6A:
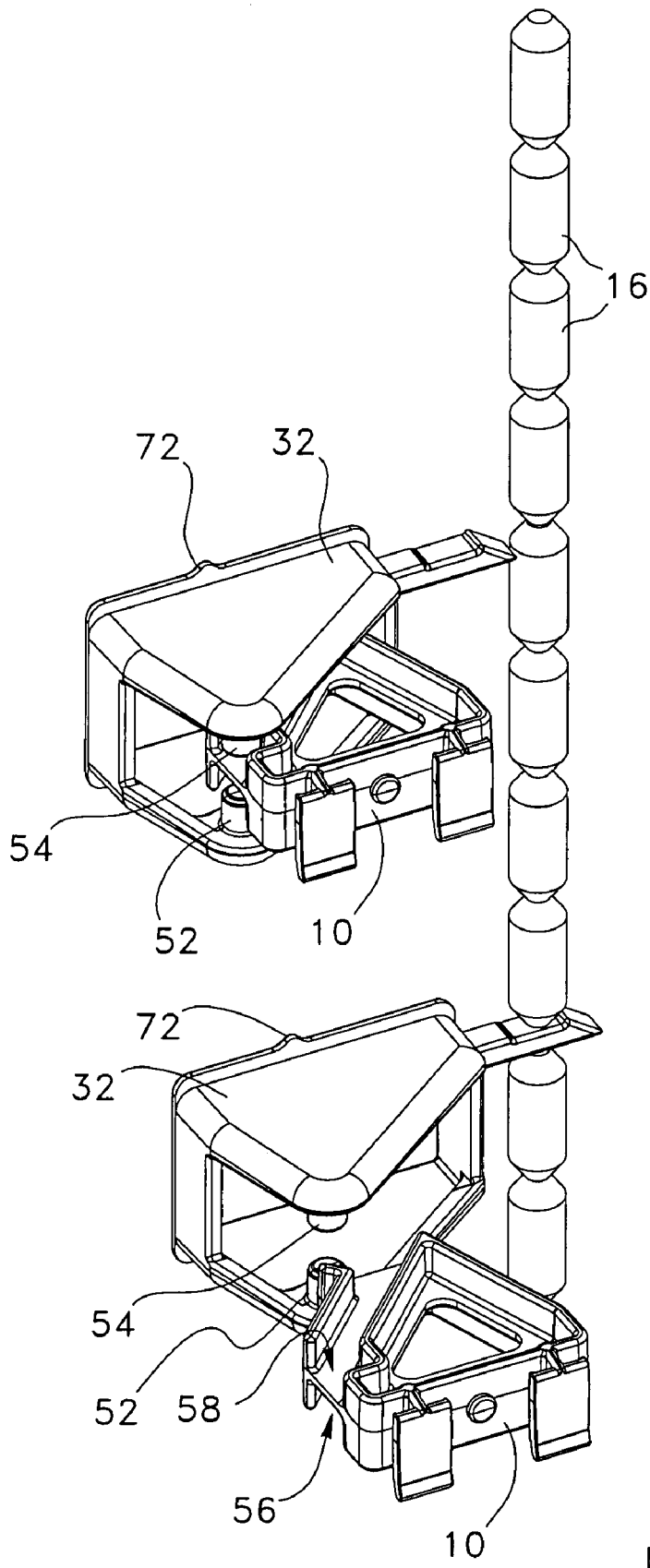
FIGS. 6A–B are partial perspective and side views of an interlocking system according to the present invention, in a lower drawer opened position.

As best shown in FIG. 5A, the shape of the activation member 10 is adapted to tolerate possible lateral variations of the drawer before it is closed. Indeed, the groove arrangement 42 has a flaring opening 50 on a side of the carriage member 32 where the pin arrangement 44 engages when the drawer is closed, guiding the pin arrangement 44 towards the groove arrangement 42 and facilitating its engagement despite possible variations in the lateral position of the drawer. Height variations in the position of the activation member 10 are also tolerated because of the length of the pin arrangement 44 which engages in the groove arrangement 42. Furthermore, since the pin arrangement 44 is formed, in the illustrated case, of upwardly and downwardly projecting facing pins 52, 54, guided in respective opposite grooves 56, 58 as best shown in FIG. 6A, the activation member 10 cannot disengage from the carriage member 32. The height of the guide support 28 and of the carriage member 32, the pins 52, 54 and the activation member 10 could be greater to tolerate greater variations in the position of the drawer in the cabinet and thus ensure proper operation. In the illustrated case, these heights have been minimized for tolerating height variations of the drawers.

As best shown in FIGS. 4B and 5B, the bolt element 34 may have a bevelled edge 60 facilitating insertion between the mobile blocks 16. The bolt element 34 may also have an upper side recess 62 adjoining the bevelled edge 60, providing a stop surface 64 impeding disengagement of the bolt element when inserted between the mobile blocks 16. Indeed, when the bolt element 34 is engaged between the rods 16, the rods 16 above the bolt element 34 will slightly fall back in the side recess 62, preventing the carriage member 32 from sliding left under the effect of eventual vibrations of the cabinet (in particular when the cabinet is a mobile one) and to cause malfunction of the system.

Figure 6B:
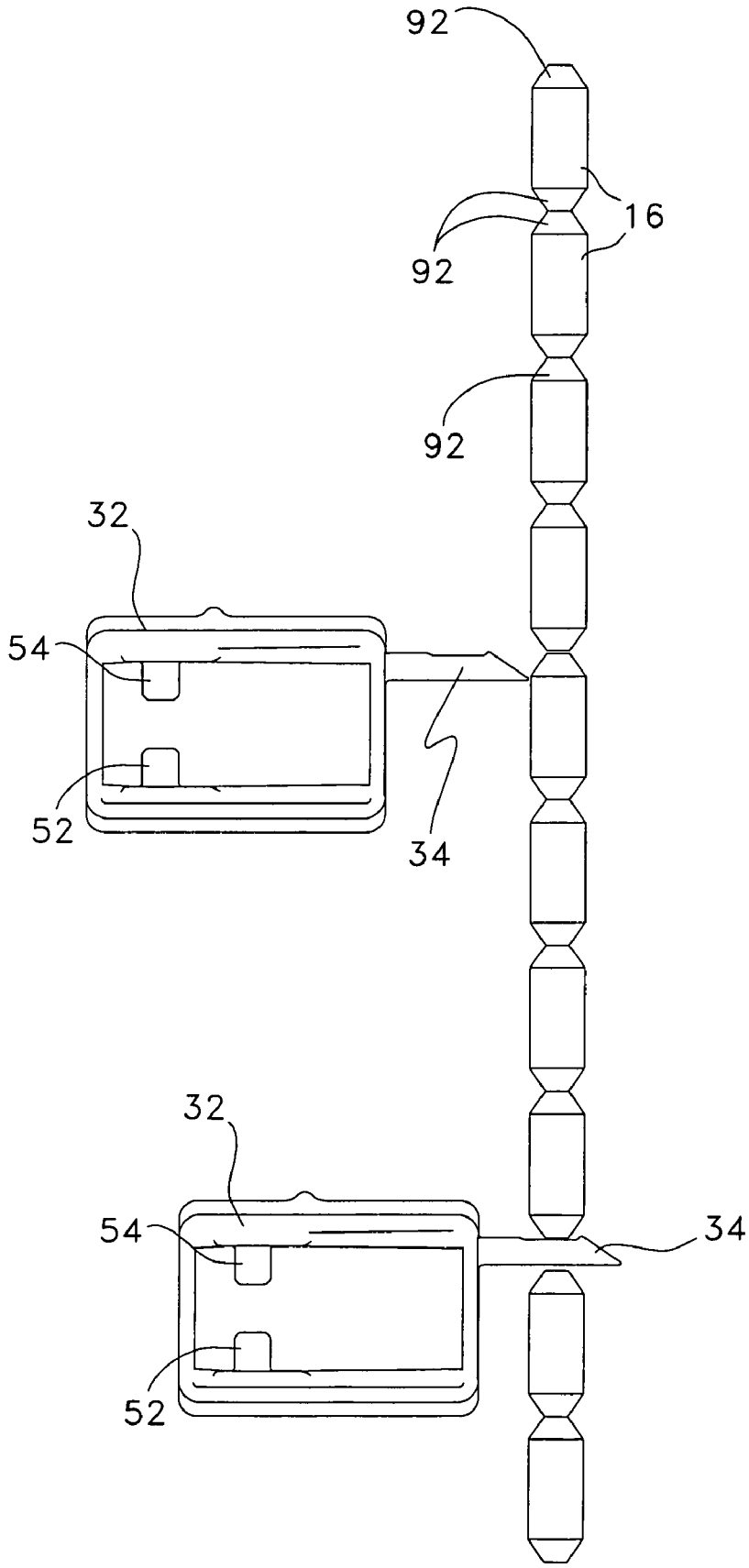
Figure 7A:
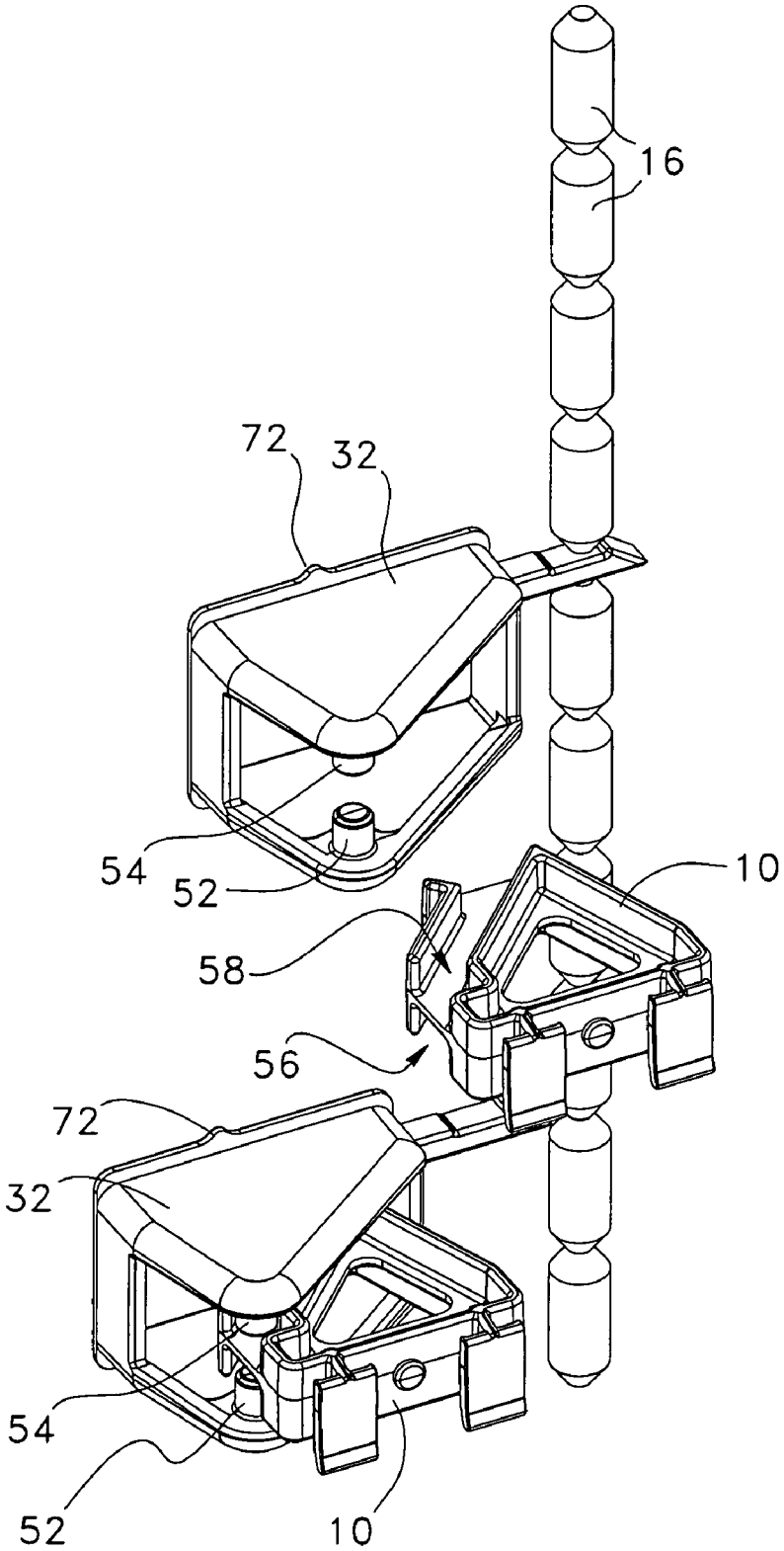
FIGS. 7A–B are partial perspective and side views of an interlocking system according to the present invention, in an upper drawer opened position.
Figure 7B:
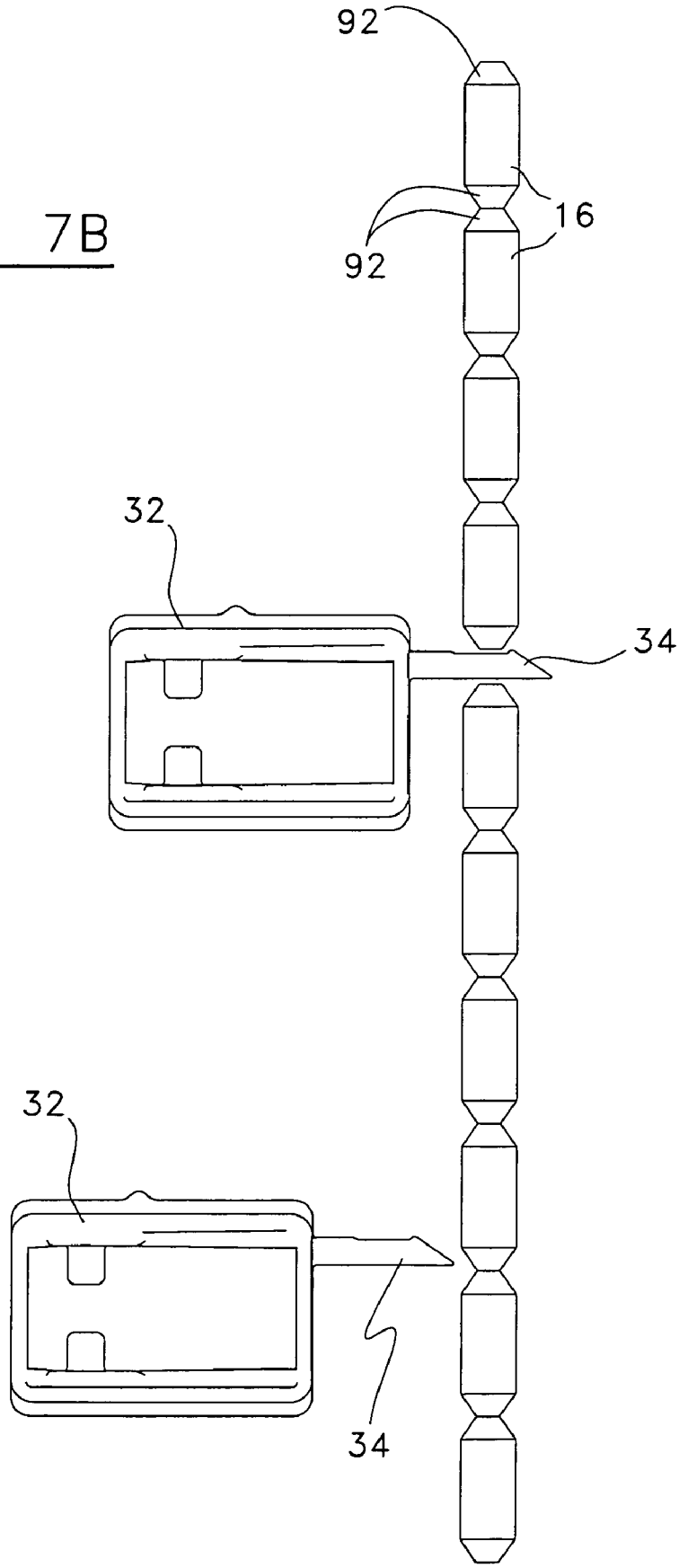

Referring to FIGS. 6A–B and 7A–B, there is shown the operation of the system and the interaction of the different mobile pieces. As shown in FIGS. 7A–B, at the opening of a drawer, in this case above other drawers, the bolt element 34 of the carriage member 32 associated to the drawer which is opened is inserted between the mobile blocks 16. The lower drawers can no longer be opened. Indeed, if the user attempts to open a drawer located under the opened drawer, the bolt element 34 of the carriage member 32 associated to that drawer cannot be inserted between the small rods 16 since they cannot move up as they are stopped under the bolt element 34 of the carriage member 32 associated to the opened drawer. Likewise, as shown in FIGS. 6A–B, it is not possible either to open the drawers located above an opened drawer. In fact, the channel 18 of the track member 14 is blocked at both ends. Above the stack of rods 16, at rest, there is a space equivalent to the thickness of a bolt element 34, with a possible play which should be less that the thickness of the bolt element 34. Consequently, when a drawer is opened, there is not any free space to allow further motion of the rods 16 in the channel 18. It is this arrangement which prevents the opening of more than one drawer. Also, with the present interlocking system, it is never possible to open more than one drawer at a time since there is not enough free space in the track member 14 to let more than one bolt element 34 be inserted.

One of the advantages of the present interlocking system is that it is very compact. Consequently, as it takes very little space, it allows a very high percentage of storage efficiency (ratio drawer dimension/cabinet dimension).

Another advantage lies in the easiness level of the installation and reconfiguration. Indeed, if a user changes the configuration of the drawers in the cabinet, he/she only has to reposition the guide supports 28 at the appropriate positions. The height of the rods 16 can be chosen to provide maximal flexibility for reconfiguration of the drawers. The rods 16 may have opposite tapered ends 92 facilitating insertion of the bolt elements 34 between them. Furthermore, the guide supports 28 could be provided with flexible tabs which clip in the mounting structure 2, allowing to move the guide supports 28 easily and quickly without using tools.

Figure 8:
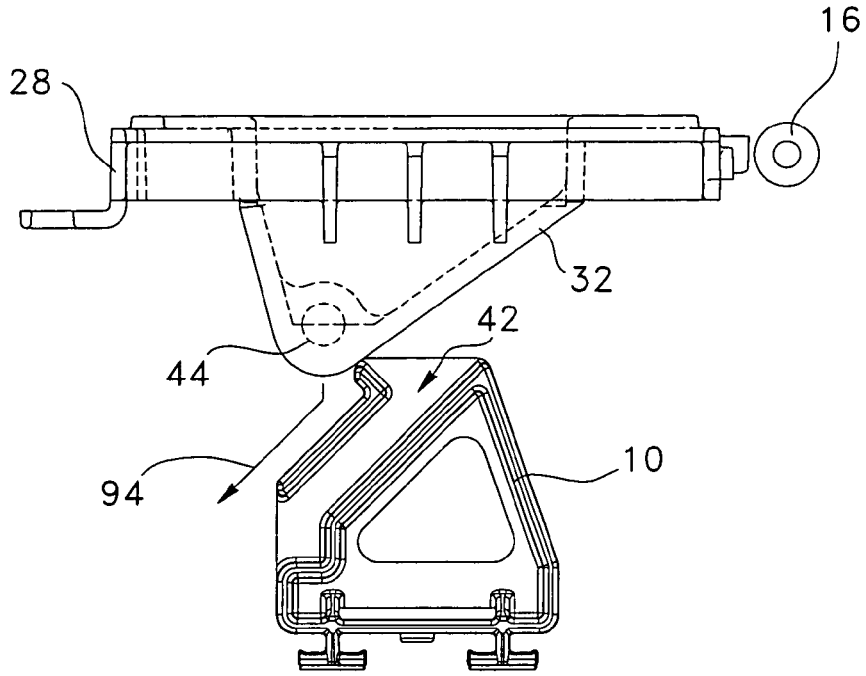
FIG. 8 is a top view of an activation member and an associated carriage member before first activation of an interlocking system according to the present invention.

Referring to FIGS. 4B and 8, the present interlocking system may also advantageously be arranged so that the drawers can be inserted consecutively without having to reset the system at the initial installation. The guide support 28 can be provided to this effect with a spring tab 66 which, when in uncompressed position, defines the normal position of the carriage member 32. As best shown in FIG. 8, if a drawer is initially closed while the carriage member 32 has not been yet activated, the pin arrangement 44 (or the pins 52, 54) will not pass by the groove arrangement 42, as it is not properly aligned for this, but will rather pass aside the groove arrangement 42. The shape of the activation member 10 and more particularly of the outer wall defining the groove arrangement 42 will push the carriage member 32 on the left as depicted by arrow 94. The spring tab 66 will then be deformed to allow displacement of the carriage member 32. When the drawer will be completely closed, the spring tab 66 will push back the carriage member 32 on the right to return it in its normal position to be ready for passing in the groove arrangement 42 at the next opening of the drawer. The spring tab 66 could be replaced by a return spring which would fulfil the same function, i.e. returning the carriage member 32, after a first coupling of the activation member 10 with the carriage member 32, from an inactive position wherein the pin arrangement 44 is misaligned and guided outside the groove arrangement 42 to an active position ready for insertion of the bolt element 34 in the space and wherein the pin arrangement 44 engages in the groove arrangement 42. Other spring devices and arrangements can be used if desired.

Referring to FIG. 9, the carriage member 32 is held in the guide support 28 by means of upper and lower projecting flanges 68 slideably engaging upper and lower back surfaces 96 of the guide support 28. The carriage member 32 may also be provided with a bump 72 frictionally engaging a rugged portion 74 in the back surface of the guide support 28, so that the carriage member 32 will not move under the effect of vibrations of the cabinet even when the activation member 10 is in opened drawer position. The positions of the bump 72 and the rugged portion 74 can also be interchanged.

The interlocking system according to the present invention can be used as a locking device. Indeed, a locking tab just need to be inserted in the space between any two rods 16, preferably above the uppermost rod through an actuation bar (not shown) connected to the lock to prevent the opening of all the drawers.

While embodiments of this invention have been illustrated in the accompanying drawings and described above, it will be evident to those skilled in the art that changes and modifications may be made therein without departing from the essence of this invention. For example, the track member 14 and the guide supports 28 could be mounted directly in the cabinet, without using the mounting structure 2, provided that the pieces are designed with proper mounting surfaces and are provided with proper mounting elements. If desired, the interlocking system could be adapted to allow the opening of a specific number of drawers, e.g. two instead of a single one, by adjusting the space in the channel 18 to the desired number of bolt elements 34 which can be inserted between the blocks 16 at a same time. The thickness of the bolt elements 34 and of the tapered ends 92 of the blocks 16 should also preferably be adjusted so that the tip of the first bolt element 34 inserted in the channel 18 hits the top of the lower tapered end 92 of the upper block 16, thereby lifting it in order that once the first bolt element 34 is fully inserted, enough space remains between the first bolt element 34 and the lower block 16 for insertion of a second, lower bolt element 34. The positions of the groove arrangement 42 and the pin arrangement 44 of the coupling arrangement between the activation members 10 and the carriage members 32 may be interchanged. It may be formed of a single groove and pin arrangement if desired, or any other suitable arrangement provided that it produces the above described sliding effect of the carriage members 32 using the pulling and pushing motions of the activation members 10 when the drawers are opened and closed.

The invention claimed is:

1. An interlocking system for preventing simultaneous opening of drawers of a cabinet, comprising:

activation members respectively affixable to back sides of the drawers;

guide supports respectively affixable in the cabinet behind the drawers, in respective registration with the activation members;

an elongated track member affixable in the cabinet on a side of the guide supports;

a series of mobile blocks slideably guided by the track member, the track member limiting the blocks to a partial displacement to produce a space between any two of the blocks;

carriage members respectively slideably mounted on the guide supports, the carriage members being movable transversely to the track member, the carriage members respectively having bolt elements projecting towards the track member and drivable one at a time in the space produced by the partial displacement of the blocks by sliding of the carriage members towards the track member; and coupling means respectively extending between the activation members and the carriage members for sliding one of the carriage members towards the track member using pulling motion of a corresponding one of the activation members during a first configuration of the interlocking system, provided that the space is vacant for receiving the bolt element of said one of the carriage members, and sliding said one of the carriage members away from the track member using pushing motion of said one of the activation members during a second configuration of the interlocking system, wherein the guide supports have upper and lower back surfaces and the carriage members have upper and lower projecting flanges respectively slideably engaging the upper and lower back surfaces of the guide supports.

2. The interlocking system according to claim 1, wherein the coupling means comprise guiding groove and pin arrangements distributed between the activation members and the carriage members.

3. The interlocking system according to claim 2, wherein each guiding groove and pin arrangement comprises a pin means extending on a front side of a corresponding one of the carriage members and a slanted groove means extending on a rear side of a corresponding one of the activation members, the pin means being engageable in the groove means and being guided therein upon pulling and pushing motions of the corresponding one of the activation members.

4. The interlocking system according to claim 3, wherein the pin means comprises a pair of upwardly and downwardly projecting facing pins, and the slanted groove means comprises a pair of opposite grooves in which the downwardly and upwardly projecting pins are respectively engageable.

5. The interlocking system according to claim 3, wherein the slanted groove means have a flaring opening on a side of the carriage members for facilitating engagement of the pin means.

6. The interlocking system according to claim 3, wherein the guide supports have spring means for returning the carriage members, after a first coupling of the activation members with the carriage members, from inactive positions wherein the pin means are misaligned and guided outside the groove means to active positions ready for insertion of the bolt elements in the space and wherein the pin means engage in the groove means.

7. The interlocking system according to claim 1, wherein one of the back surfaces of the guide supports and a corresponding one of the flanges of the carriage members have respectively a rugged portion and a bump frictionally engaging the rugged portion.

8. The interlocking system according to claim 1, further comprising a mounting structure having opposite first and second mounting rails affixable in the cabinet behind the drawers and between which the guide supports are mountable, the second mounting rail providing a support structure for the track member.

9. The interlocking system according to claim 8, wherein the guide supports have first and second opposite ends respectively attachable to the mounting rails at adjustable heights along the mounting rails.

10. The interlocking system according to claim 9, wherein the second end of the guide supports has hooking means for hooking attachment through perforations in the second mounting rail, and the first end of the guide supports has a projecting bracket screwable to the first mounting rail.

11. The interlocking system according to claim 8, wherein the mounting structure has a back wall extending between the first and second mounting rails.

12. The interlocking system according to claim 8, wherein the mounting rails have lower ends provided with downwardly projecting tabs for engagement in corresponding slots, and upper ends shaped for engagement in holes in an upper supporting structure of the cabinet.

13. The interlocking system according to claim 1, wherein the elongated track member has a longitudinal side channel and the mobile blocks comprise rods slideably fitting in the side channel.

14. The interlocking system according to claim 13, wherein the rods have opposite tapered ends facilitating insertion of the bolt elements between the rods.

15. The interlocking system according to claim 1, wherein the bolt elements have bevelled edges facilitating insertion of the bolt elements between the mobile blocks.

16. The interlocking system according to claim 15, wherein the bolt elements have upper side recesses adjoining the bevelled edges, providing stop surfaces impeding disengagement of the bolt elements when inserted between the mobile blocks.

17. The interlocking system according to claim 1, wherein the activation members have clipping means for clipping the activation members to the back sides of the drawers.

* * * * *